US010596434B2

(12) United States Patent
Frank

(10) Patent No.: US 10,596,434 B2
(45) Date of Patent: Mar. 24, 2020

(54) PULL BUOY

(71) Applicant: Jordan Frank, Providence, RI (US)

(72) Inventor: Jordan Frank, Providence, RI (US)

( * ) Notice: Subject to any disclaimer, the term of this patent is extended or adjusted under 35 U.S.C. 154(b) by 0 days.

(21) Appl. No.: 15/634,119

(22) Filed: Jun. 27, 2017

(65) Prior Publication Data

US 2018/0008875 A1 Jan. 11, 2018

Related U.S. Application Data

(60) Provisional application No. 62/360,933, filed on Jul. 11, 2016.

(51) Int. Cl.

| | |
|---|---|
| ***B63C 9/08*** | (2006.01) |
| ***B63C 9/28*** | (2006.01) |
| ***A63B 69/00*** | (2006.01) |
| ***A63B 69/12*** | (2006.01) |

(52) U.S. Cl.

CPC ..... *A63B 69/0059* (2013.01); *A63B 69/12* (2013.01); *A63B 2069/0062* (2013.01); *A63B 2208/03* (2013.01); *A63B 2244/20* (2013.01)

(58) Field of Classification Search

CPC ..... A63B 69/10; A63B 69/12; A63B 69/0057; A63B 69/0059; A63B 2069/0062; A63B 2244/20; A63B 2208/03; B63B 22/00; B63B 22/22; B63B 2022/00; B63B 2207/00

USPC ..... 441/80, 88, 90, 125, 129, 133, 134, 136; 482/55

See application file for complete search history.

(56) References Cited

U.S. PATENT DOCUMENTS

| | | | | |
|---|---|---|---|---|
| 739,909 | A | 9/1903 | Ogle et al. | |
| D217,644 | S | 5/1970 | Smith | |
| 3,604,023 | A | 9/1971 | Lynch | |
| 4,362,518 | A * | 12/1982 | Boissiere | A63B 69/14 441/60 |
| 4,379,704 | A | 4/1983 | Rademacher | |
| 4,929,205 | A | 5/1990 | Jones | |
| 5,092,802 | A | 3/1992 | Jones | |
| D345,668 | S | 4/1994 | Braly | |
| 5,878,453 | A | 3/1999 | Stokes | |
| D408,677 | S | 4/1999 | Parnham | |

(Continued)

FOREIGN PATENT DOCUMENTS

KR 20160084350 A 7/2016

OTHER PUBLICATIONS

AXIS, "Dual-Function Pull Buoy," Accessed Apr. 20, 2017, 1 page, FINISinc.com.

(Continued)

*Primary Examiner* — Daniel V Venne
(74) *Attorney, Agent, or Firm* — LaBatt, LLC

(57) ABSTRACT

A flotation component, such as for a pull buoy, can be sized and shaped to be placed between the legs of a swimmer. The flotation component can include one or more features to assist in maintaining the flotation component in place while the swimmer is swimming. A pull buoy including the flotation component also can include an internally routed strap that assists in fastening the flotation component to at least one leg. A pull buoy including the flotation component can include a waist portion having a lateral diameter that decreases from one end to the opposite end.

20 Claims, 11 Drawing Sheets

(56) References Cited

U.S. PATENT DOCUMENTS

| | | | | |
|---|---|---|---|---|
| 6,436,014 | B1 * | 8/2002 | Cirjak | A63B 21/0606 446/26 |
| 6,793,549 | B1 | 9/2004 | Chiang | |
| 7,169,000 | B1 | 1/2007 | Hernandez et al. | |
| 7,379,704 | B2 | 5/2008 | Parker et al. | |
| D579,706 | S | 11/2008 | Cox et al. | |
| D653,486 | S | 2/2012 | Wood | |
| D728,970 | S | 5/2015 | Gilroy | |
| D736,882 | S | 8/2015 | Chen | |
| D739,909 | S | 9/2015 | Mix et al. | |
| 9,259,632 | B2 | 2/2016 | DiLorenzo et al. | |
| 9,278,257 | B2 | 3/2016 | Kacar | |
| D763,601 | S | 8/2016 | Hill | |
| 9,522,303 | B2 | 12/2016 | Kim | |
| D775,863 | S | 1/2017 | Jensen | |
| 2008/0081526 | A1 | 4/2008 | Hagedorn | |
| 2013/0074269 | A1 * | 3/2013 | Phillips, II | A61F 5/0193 5/648 |
| 2013/0344756 | A1 * | 12/2013 | Day | A63B 31/12 441/60 |
| 2014/0030940 | A1 * | 1/2014 | Day | A63B 31/12 441/60 |
| 2015/0258386 | A1 | 9/2015 | Kim | |
| 2015/0283447 | A1 * | 10/2015 | DiLorenzo | A63B 69/12 482/55 |
| 2015/0290500 | A1 | 10/2015 | Clisson | |
| 2015/0343267 | A1 * | 12/2015 | Kacar | A63B 31/00 441/129 |
| 2016/0114234 | A1 | 4/2016 | DiLorenzo et al. | |
| 2016/0175655 | A1 * | 6/2016 | Kacar | A63B 69/14 441/129 |

OTHER PUBLICATIONS

Aquagear, "Aqua Sphere P2K Pull Buoy Kickboard Combo," Accessed Apr. 20, 2017, 1 page, www.aquagear.com/aqua-sphere-p2k/.

Aqua Sphere, "Classic Pull Buoy," Accessed Apr. 20, 2017, 1 page, www.aquasphereswim.com/us/training-gear/tem/135-classic-pull-buoy.

Aqua Sphere, "ErgoBuoy," Accessed Apr. 20, 2017, 1 page, www.aquasphereswim.com/us/men/men-training-gear/training-gear-men-swim-training/erobuoy.

Kemp USA, "Kemp USA Adjustable Pull Buoy," Accessed Apr. 20, 2017, 1 page, www.kempusa.com/kemp-usa-adjustable-pull-buoy.

Tritan Swim Tech, "Pull Buoy," Accessed Apr. 20, 2017, 1 page, BetterTimes.org.

Speedo, "Team Pull Buoy," Accessed Apr. 20, 2017, 3 pages, www.speedousa.com/team-pull-buoy-style-7753023.

Huub, "Big Buoy 4—Pull Buoy," Jul. 18, 2017, 2 pages, https://www.huubusa.com/collections/swim-accessories/products/huub-u.

Huub, "HUUB Kickboard," Jul. 18, 2017, 2 pages, https://www.huubusa.com/collections/swim-accessories/products/huub-u.

Swim Keel, "Swim Keel—SKU: 1E358," Jul. 18, 2017, 3 pages, https://www.arenawaterinstinct.com/en_global/swim-keel.html.

swimrunshop.com, "SwimRunners Belt—Guidance Team Kit," Jul. 18, 2017, 5 pages, http://swimrunshop.com/product/swimrunners-pull-belt-guidance-team-ki.

Swimrunshop.com, "SwimRunners Pull Buoy—Orange," Jul. 18, 2017, 5 pages, http://swimrunshop.com/product/swimrunners-pull-buoy-orange/.

"SwimRun Pull Buoy Modification," YouTube Video Capture, 2016, 1 page.

Frank, J., International Application No. PCT/US2017/039413, International Search Report and Written Opinion, dated Sep. 21, 2017, 13 pages.

Kim, S. G., International Application No. PCT/US2018/029301, International Search Report and Written Opinion, dated Aug. 10, 2018, 12 pages.

Olson, L., U.S. Appl. No. 15/962,538, Office Action 1, dated Apr. 26, 2019, 8 pages.

* cited by examiner

PULL BUOY

REFERENCE TO RELATED APPLICATIONS

The current application claims the benefit of U.S. Provisional Application No. 62/360,933, filed on 11 Jul. 2016, which is hereby incorporated by reference.

TECHNICAL FIELD

The present invention pertains to flotation aids used in swimming, and more particularly to a pull buoy designed to immobilize and/or float a swimmer's legs in order to allow the swimmer to focus on his/her upper body motions.

BACKGROUND ART

Currently, the predominant pull buoys for swimming involve a figure-eight shaped float that a swimmer holds tight between his/her thighs. Other pull buoys involve an ankle cuff with openings on the outside of each ankle cylinder which allows the swimmer to insert or remove his/her ankles from the buoy. One ankle cuff approach involves fins on the buoy while another approach excludes the fins.

The existing solutions require varying degrees of inconveniences while swimming. For example, the figure-eight shaped float requires the swimmer to squeeze his/her thighs tightly to keep the pull buoy in place. The pull buoy requires frequent placement adjustments while swimming and is difficult to keep in place, for example, when kicking off a wall of a pool to change direction. The ankle buoy approach is easier than the figure eight format because the buoy stays in place by hanging around the ankles. However, this design also has key limitations. First, because both ankles are cuffed, the ankle buoy creates some difficulty when the swimmer turns around and kicks off a wall. Second, the ankle buoy may not maintain a precise position due to ample room present within the holes, leaving the ankles ample freedom, so the ankle buoy does not provide a snug fit. If the swimmer pulls the ankle buoy upwards to the calf or below the knee, then there is pressure around the circumference of the calf but there is not sufficient pressure to keep the ankle buoy in place during swimming. Finally, the presence of the flotation device so far to the tail end of the body creates an unnatural ballast, increasing the difficulty for the swimmer to keep the legs aerodynamically streamlined behind the body, and the legs wag.

Another approach involves an upside down T-shaped flotation device that is held between the legs with a strap that is wrapped around the swimmer's waist. This approach improves upon the figure eight design but the T-shape device is not able to immobilize the swimmer's legs and allows the legs to sink. As a result, the T-shaped pull buoy does not streamline the swimmer's legs, which is often the goal of a pull buoy.

Another approach includes a simple rubber band that binds the ankles together without any flotation. Again, this device allows the swimmer's legs to sink.

SUMMARY OF THE INVENTION

In view of the above, the inventor recognizes a need to offer a swimmer a pull buoy that may be placed in any position along the legs, including between the thighs, the upper calves or the ankles. The pull buoy can be secured in a manner that is snug, streamlines the swimmer aerodynamically, and/or can immobilize the legs. Additionally, the pull buoy can also allow the swimmer to easily kick off the side of a pool and resume swimming in a different direction.

A flotation component, such as for a pull buoy, can be sized and shaped to be placed between the legs of a swimmer. The flotation component can include one or more features to assist in maintaining the flotation component in place while the swimmer is swimming. A pull buoy formed using the flotation component can include a strap that assists in holding the flotation component in place. The flotation component can include a waist portion having a lateral diameter that decreases from one end to the opposite end. Accordingly, the end of the waist portion pointing towards the swimmer's groin can be wider than the end of the waist portion pointing towards the swimmer's feet. This tapering of the waist portion provides better ergonomics and counteracts the rearward pressure of water flow as the swimmer moves forward in the water.

The present aspects of the invention provide a pull buoy and a means to secure the pull buoy to at least one leg using at least one strap or any other means which will surround the leg sufficiently to secure the pull buoy to prevent rotation around the at least one leg.

A first aspect of the invention provides a buoy, comprising: a flotation component configured to be secured between legs of a swimmer, wherein the flotation component includes: a top portion having a first lateral diameter; a waist portion having a second lateral diameter smaller than the first lateral diameter, wherein the second lateral diameter decreases from a first end of the flotation component to a second end of the flotation component; and a bottom portion having a third lateral diameter larger than the second lateral diameter.

A second aspect of the invention provides a buoy, comprising: a flotation component configured to be secured between legs of a swimmer, wherein the flotation component includes: a top portion having a first lateral diameter; a waist portion having a second lateral diameter smaller than the first lateral diameter; and a bottom portion having a third lateral diameter larger than the second lateral diameter; and a strap including two ends extending from a top location and a bottom location a first lateral side of the flotation component, wherein the top location is located between a vertical center of the buoy and a vertical location of the first lateral diameter, and wherein the bottom location is located between the vertical center of the buoy and a vertical location of the third lateral diameter; and means for securing the two ends of the strap around one of the legs.

A third aspect of the invention provides a buoy, comprising: a flotation component including a set of angled slots, wherein the set of angled slots include a pair of openings located on a first lateral side of the flotation component, and wherein an end of each angled slot in the set of angled slots furthest from the first lateral side is closer to a vertical center of the flotation component than each opening located on the first lateral side of the flotation component; a strap routed through the set of angled slots in the flotation component and extending from a pair of openings located on a first lateral side of the flotation component; and means for securing the first lateral side of the flotation component to a swimmer using the strap.

Embodiments of the invention provide a buoy that fits properly between the thighs, the upper calves or the ankles, with a strap or other means to secure the buoy to one leg.

Embodiments of the invention include material(s) that provides a support for the leg that is connected to the strap, e.g., to provide a degree of comfort, fit, and/or flotation.

Embodiments of the invention include material(s) that provides a support for the leg that is not connected to the strap, e.g., to prevent the buoy from floating upwards by reducing any rotational force that may cause the buoy to slip upwards and rotate around the strapped leg. The material also can act as a "shelf" on which the un-strapped leg can be placed after kicking off a wall. The material can stabilize the buoy so that the swimmer does not need to squeeze the buoy between his/her legs in order to keep the buoy from moving.

Embodiments of the invention can incorporate strap(s) for securing both legs, which can fully immobilize both of the legs and may be preferred by some swimmers.

Embodiments describe use of one or more straps to secure the buoy to the leg(s) of a swimmer. However, other solutions can be implemented to secure the buoy to a leg. For example, an opening may be cylindrical or nearly cylindrical with the material of the flotation device having enough elasticity to stretch around a leg, but still provide enough tension to remain secured to a desired location on the leg.

A buoy could be made of a variety of materials. In an embodiment, the buoy can be made of a foam material. In another embodiment, the buoy can be made of an inflatable form. However, it is understood that the buoy can be formed of any other buoyant material.

The illustrative aspects of the invention are designed to solve one or more of the problems herein described and/or one or more other problems not discussed.

BRIEF DESCRIPTION OF THE DRAWINGS

These and other features of the disclosure will be more readily understood from the following detailed description of the various aspects of the invention taken in conjunction with the accompanying drawings that depict various aspects of the invention.

FIGS. 3A-3D show various views of an illustrative buoy according to another embodiment, while

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide a swimming pull buoy with means for securing the buoy to a desired location on a swimmer. In illustrative embodiments, the means includes at least one strap connecting the buoy to at least one leg.

Figure 1A:
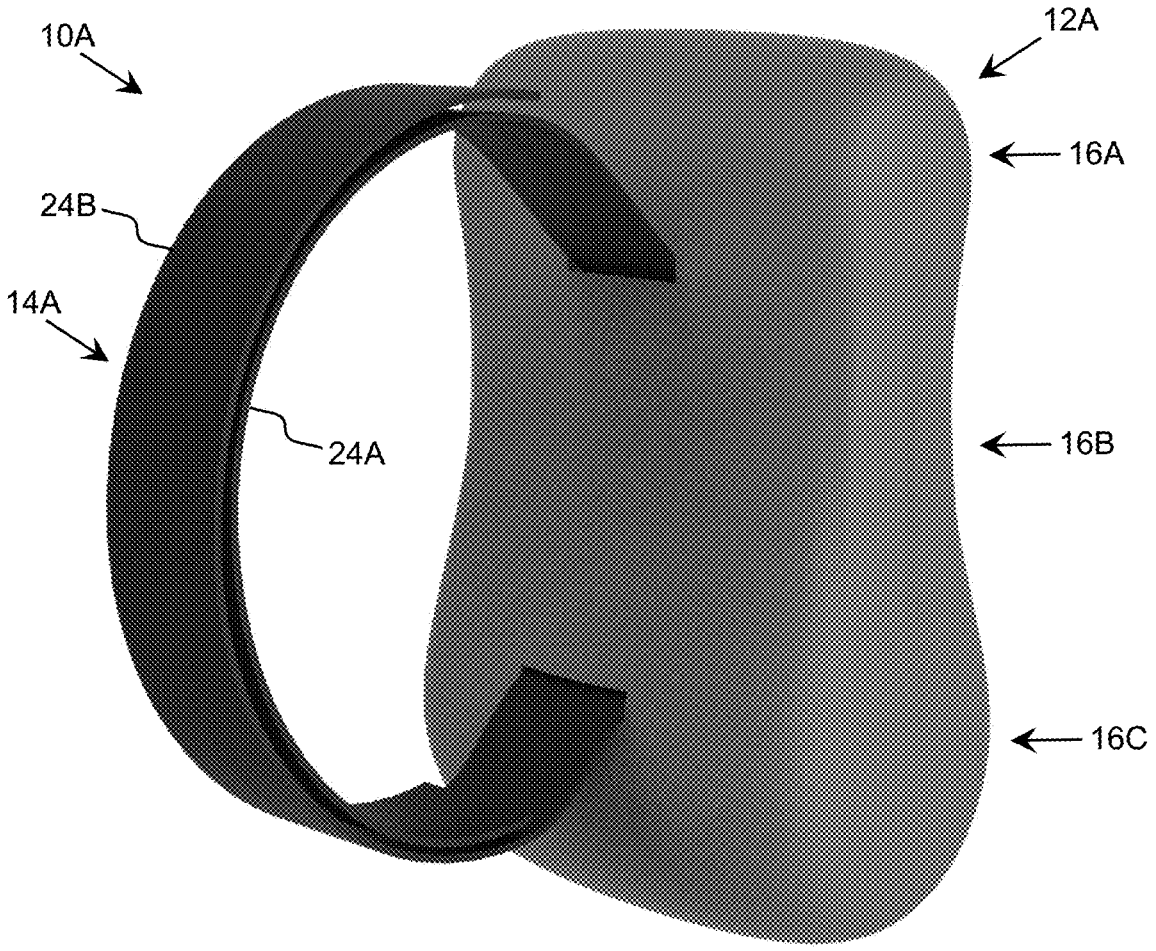
FIGS. 1A-1E show various views of an illustrative buoy according to an embodiment.
Figure 1B:
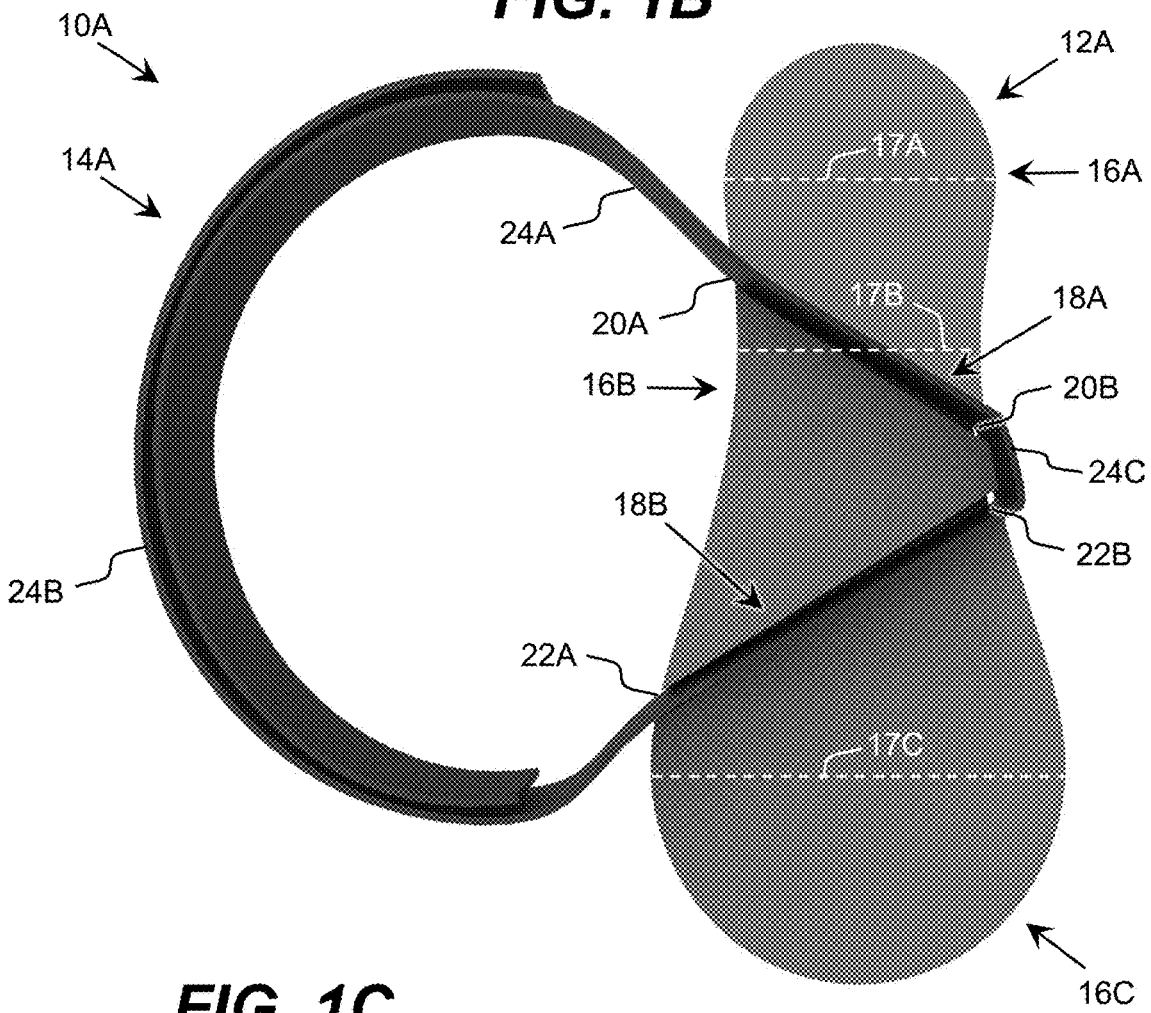
Figure 1C:
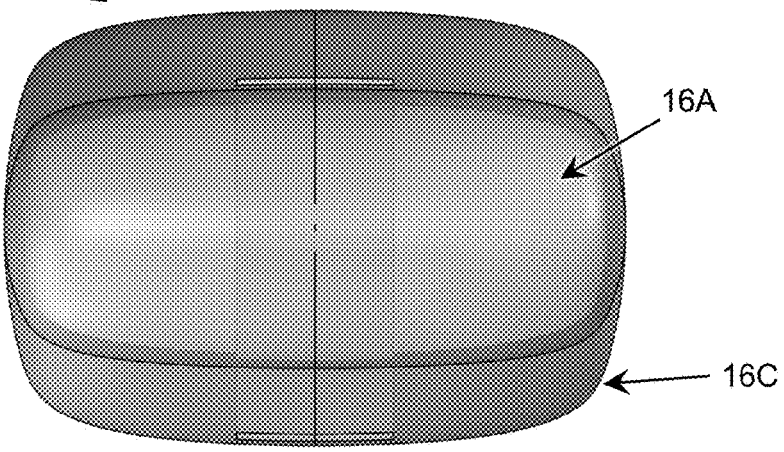
Figure 1D:
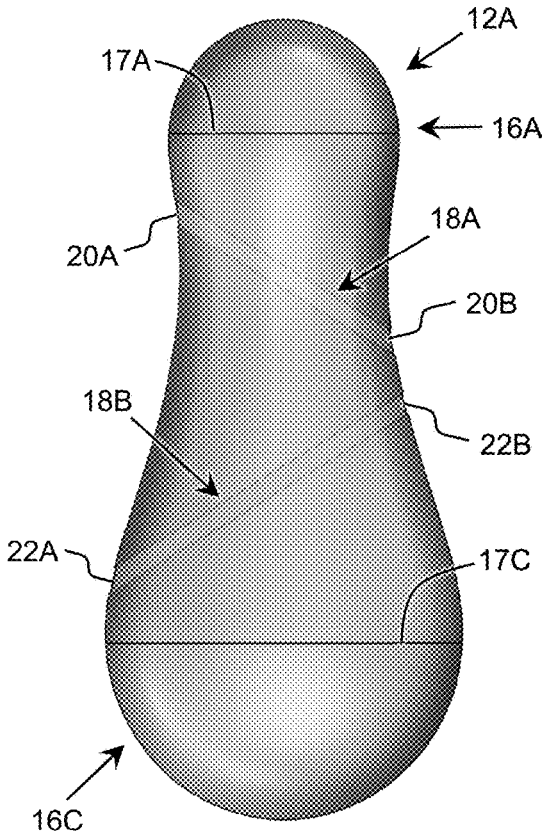
Figure 1E:
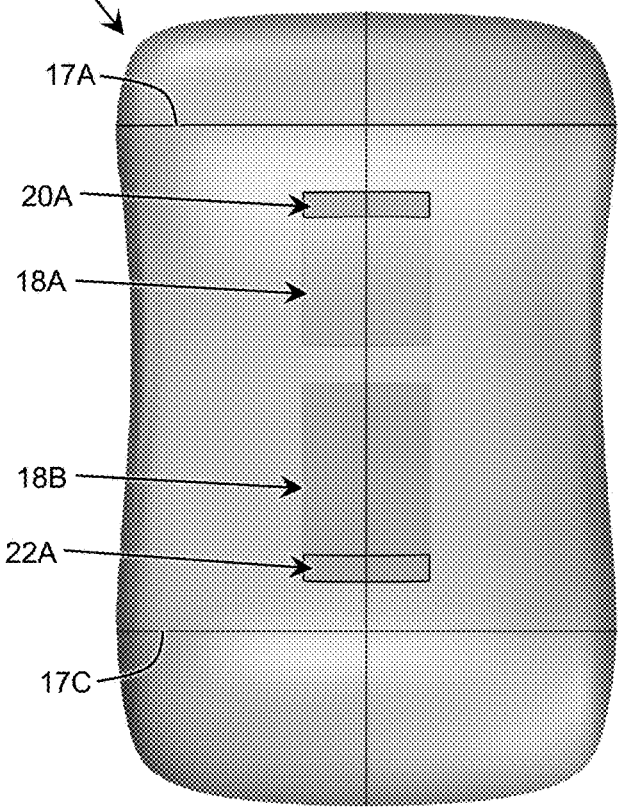

Turning to the drawings, FIGS. 1A-1E show various views of an illustrative buoy 10A including a flotation component 12A and a strap 14A according to an embodiment. In particular, FIG. 1A shows a perspective view of the buoy 10A, FIG. 1B shows a front cutaway view of the buoy 10A, and FIGS. 1C-1F show top, front, and side views, respectively, of a flotation component 12A of the buoy 10A according to an embodiment.

As illustrated in FIGS. 1A-1E, the flotation component 12A can be sized and shaped to be comfortably placed between the legs of a user. Any of numerous sizes and shapes are possible. As illustrated, the flotation component 12A can have a generally figure-eight frontal cross section, with a rounded top portion 16A, a narrowed waist portion 16B, and a rounded bottom portion 16C. The top portion 16A and bottom portion 16C can be approximately the same size. Alternatively, as shown, the rounded bottom portion 16C can be larger than the rounded top portion 16A. Regardless, the top portion 16A can have a maximum lateral diameter at a vertical location 17A, the narrowed waist portion 16B can have a minimum lateral diameter at a vertical location 17B, and the bottom portion 16C can have a maximum lateral diameter at a vertical location 17C. The maximum or minimum lateral diameter associated with each portion 16A-16C is also referred to as the lateral diameter of the corresponding portion 16A-16C. When a portion includes a vertical extent having the same maximum or minimum lateral diameter, a vertical midpoint of the extent can be considered a vertical location for the maximum or minimum lateral diameter. The flotation component 12A can be formed of any suitable material. Illustrative materials include lightweight, buoyant materials, such as foam, inflatable plastic, and/or the like.

In an embodiment, the rounded bottom portion 16C has a diameter that is approximately 1.55 times (e.g., in a range of 1.4 to 1.7 times) the diameter of the rounded top portion 16A and approximately 1.75 times (e.g., in a range of 1.6 to 1.9 times) the diameter of the narrowed waist portion 16B. Additionally, the diameter of the rounded bottom portion 16C can be approximately 45% (e.g., in a range of 40% to 50%) of the height of the flotation component 12A. In an embodiment, the rounded top portion 16A can have a diameter that is approximately 1.15 times (e.g., in a range of 1.05 to 1.25 times) the minimum diameter of the narrowed waist portion 16B. The minimum diameter of the waist portion 16B can be at a location approximately one third (e.g., in a range of 28% to 38%) from the top of the flotation component 12A. When the bottom portion 16C and top portion 16A are the same size, the bottom portion 16C and top portion 16A can have a diameter that is in a range of 1.05 to 1.7 times the minimum diameter of the narrowed waist portion 16B. Regardless, it is understood that the various differences in diameters are only illustrative, and embodiments of a flotation component described herein can have diameters that are beyond the ranges described herein.

As illustrated, the strap 14A can comprise a single strap that is internally routed through slots 18A, 18B located within the flotation component 12A. In an embodiment, the slots 18A, 18B are angled. In a more particular embodiment, a top slot 18A can include an opening 20A located approximately 25% (e.g., in a range of 20% to 30%) from the top of the flotation component 12A and an opening 20B located approximately 40% (e.g., in a range of 35% to 45%) from the top of the flotation component 12A. Additionally, a bottom slot 18B can include an opening 22A located approximately 33% (e.g., in a range of 28% to 38%) from the bottom of the flotation component 12A and an opening 22B located approximately 50% (e.g., in a range of 45% to 55%) from the bottom of the flotation component 12A. Openings 20A, 22A can be located on the same side of the flotation component 12A and spaced sufficiently apart to allow the user to place a portion of his/her leg comfortably there between. As illustrated, the openings 20A, 22A can be located closer to a vertical center of the flotation component 12A than the corresponding vertical locations 17A, 17C for the top and bottom maximum lateral diameters.

The strap 14A can include top and bottom external ends 24A, 24B, respectively, which are configured to attach to one another around a leg/ankle of a user. One or both of the external ends 24A, 24B can include a set of mechanisms (e.g., mechanisms 71A, 71B shown in FIG. 7B) for securing the external ends 24A, 24B to one another. For example, the external ends 24A, 24B can have complementary components of a hook and loop fastener fastened thereto using any solution (e.g., sewn, glued, and/or the like). Alternatively, one external end 24A, 24B can include a wraparound clasp, which can allow the other external end 24A, 24B to be looped through and folded back to fasten onto itself (e.g., via a hook and loop fastener or the like). Other securing mechanisms, such as securing mechanisms 63A, 63B shown in FIG. 6B, also can be utilized including, for example, any of various types of buckles (e.g., side release buckles), which can enable the external ends 24A, 24B to be secured in multiple alternative locations, and/or allow adjustment of a location of the buckle mechanism located on one or both external ends 24A, 24B.

The strap 14A further includes a central portion 24C, which is routed within the top and bottom slots 18A, 18B of the flotation component 12A and between the openings 20B, 22B located on the opposing side of the flotation component 12A as the external ends 24A, 24B. The external ends 24A, 24B and central portion 24C each can be fabricated from any combination of one or more suitable materials. For example, each external end 24A, 24B can be formed of any material that can securely encompass the swimmer's leg so that the buoy 10A does not rotate around the swimmer's leg or shift up or down the swimmer's leg during normal swimming. For example, each external end 24A, 24B can be formed of a neoprene fabric, rubber, and/or the like. In an embodiment, the central portion 24C can be formed of the same material as the external ends 24A, 24B. However, it is understood that the central portion 24C also can be formed of a different material, which can be configured to provide additional support. For example, the central portion 24C can be formed of a material having additional stiffness, such as a plastic. When formed of different pieces (e.g., different materials), the central portion 24C can be permanently attached to the external ends 24A, 24B using any solution, such as sewing, adhesive, and/or the like. When internally routed, it is understood that the ends of one or more of the external ends 24A, 24B can be fabricated to have an increased stiffness than the remainder of the external ends 24A, 24B to facilitate routing the strap 14A through the flotation component 12A.

The flotation component 12A and strap 14A can include one or more attributes selected to facilitate securing the pull buoy 10A to a desired location on a swimmer's leg. To this extent, for a pull buoy 10A intended to be secured between the thighs of a swimmer, the flotation component 12A can have a size conducive for comfortable placement between the thighs of a typical swimmer. In an embodiment, the flotation component 12A can have an overall height of approximately 9.5 inches (e.g., in a range of 8 to 11 inches), and the bottom portion 16C can have a maximum diameter of approximately 4.3 inches (e.g., in a range of 3 to 5.5 inches), with the waist portion 16B and top portion 16A proportionally smaller as described herein.

Furthermore, the openings 20A, 22A can be located approximately four inches (e.g., in a range of three to five inches) apart. Additionally, the external ends 24A, 24B of the strap 14A can be approximately two to three inches wide, with an overall front to back width of the flotation component 12A being approximately six inches (e.g., five to seven inches). Regardless, it is understood that these dimensions are only illustrative and different size pull buoys 10A can be fabricated for use with smaller or larger swimmers and/or for placement in different locations of the legs, such as the calves, ankles, and/or the like. To this extent, embodiments of a pull buoy 10A can include dimensions that are scaled larger or smaller than these dimensions, while maintaining a similar ratio of sizes for the various features.

In an embodiment, at least a portion of the flotation component 12A and/or strap 14A that is intended to directly contact the swimmer's leg when the pull buoy 10A is utilized can include one or more features to increase an amount of friction to further assist in holding the pull buoy 10A in place during use. For example a surface of the flotation component 12A and/or strap 14A can be textured. In an embodiment, at least a portion of an external end 24A, 24B can include a plurality of flexible rubber beads to increase the friction against the swimmer's leg.

The pull buoy 10A can be manufactured using any solution. For example, in an embodiment, the flotation component 12A comprises three die-cut foam pieces, which are adhered together to form the pull buoy 10A. Each die-cut foam piece can correspond to the rounded top portion 16A, the narrowed waist portion 16B, and the rounded bottom portion 16C. The narrowed waist portion 16B can be permanently secured (e.g., glued) to the top and bottom portions 16A, 16C along either side of the corresponding slot 18A, 18B. Prior to securing one or both sides of the slots 18A, 18B, the central portion 24C of the strap 14A can be routed therein. In this case, the external ends 24A, 24B of the strap 14A can be larger than the openings of the slots 18A, 18B, thereby preventing the strap 14A from being removed from one or both of the slots 18A, 18B.

Figure 2:
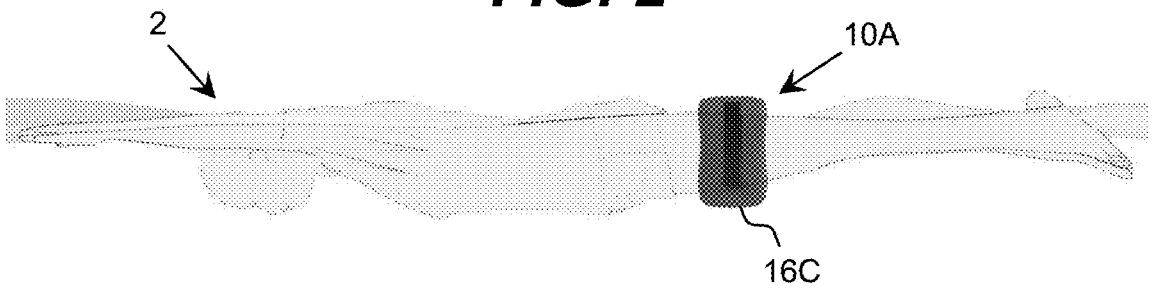
FIG. 2 shows a side view of a swimmer using a buoy according to an embodiment.

As discussed herein, a pull buoy described herein can be utilized by a swimmer. In particular, a pull buoy described herein can be held at any location between the swimmer's legs. To this extent, FIG. 2 shows a side view of a swimmer 2 using a pull buoy described herein, such as the pull buoy 10A, according to an embodiment. When the top and bottom portions 16A, 16C have different sizes, the larger size can be oriented down while the swimmer 2 is swimming to provide additional flotation and to help prevent the buoy from floating up. As illustrated, the pull buoy 10A is mounted between the thighs of the swimmer 2, with the swimmer 2 facing down. In this case, the bottom portion 16C is located at the front of the swimmer's thigh. However, it is understood that the pull buoy 10A could be mounted with the bottom portion 16C located at the back of the swimmer's thigh (or other location along the back of the swimmer's leg). In this case, the swimmer 2 can swim facing up. Regardless, as described herein, a pull buoy can be configured to be located at any position along the swimmer's leg, including the calf, the ankles, and/or the like.

As illustrated in FIGS. 1A-1E, the flotation component 12A can have a top portion 16A and a bottom portion 16C having a slightly larger diameter in the center of front to back width of the pull buoy 10A than on the outer front and back regions. The waist portion 16B can have a substantially uniform diameter (e.g., within +/−5%) along the entire front to back width. Alternatively, the top portion 16A, narrowed waist portion 16B, and rounded bottom portion 16C can have substantially uniform diameters along a front to back width of the pull buoy 10A. In particular, the flotation component 12A can have only a slight variation along the width for providing rounded front and back sides as well as a slightly wider central region. In either case, the flotation component 12A can be substantially symmetrical about an axis that runs along the center of the front to back width.

Figure 3A:
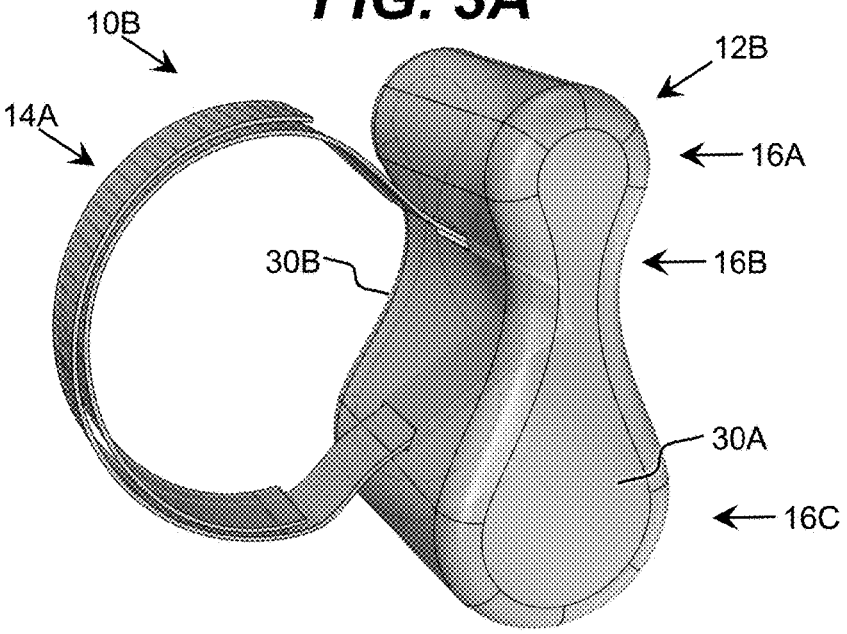
Figure 3B:
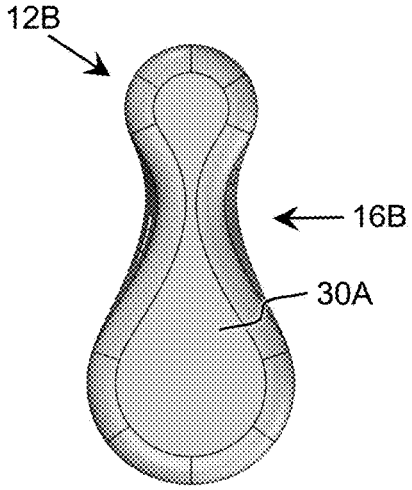
Figure 3C:
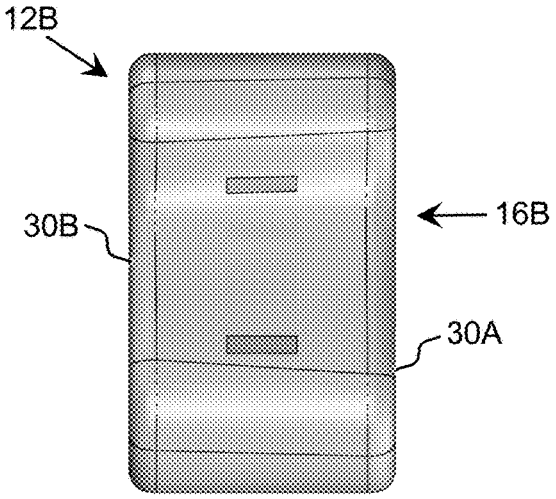
Figure 3D:
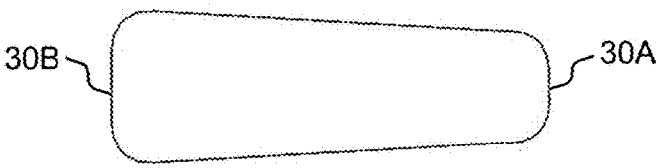

Alternatively, a flotation component can include one or more portions 16A-16C having a diameter that varies significantly (e.g., +/−5% or greater) along the front to back width of the flotation component. For example, the flotation diameter can include one or more tapered regions, which can be configured to counteract the flow of water by creating a force that pulls the pull flotation component towards the groin of the swimmer. To this extent, FIGS. 3A-3D show various views of an illustrative pull buoy 10B according to another embodiment. In particular, FIG. 3A shows a perspective view of the buoy 10B, FIG. 3B shows a front view of a flotation component 12B of the buoy 10B, and FIG. 3C shows a side view of the flotation component 12B according to an embodiment. FIG. 3D shows a cross-section of the flotation component 12B along the minimum diameter of the narrowed waist portion 16B.

Figure 3E:
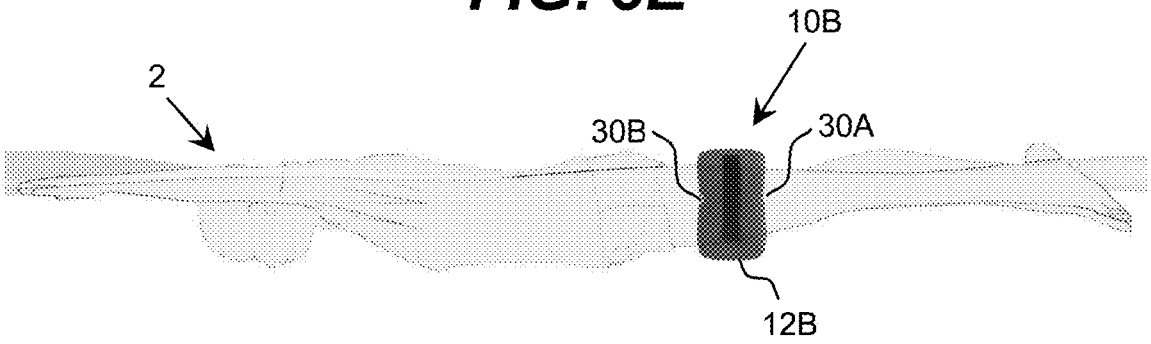
FIG. 3E shows a side view of a swimmer using the buoy according to an embodiment.

As illustrated in FIGS. 3A-3D, the narrowed waist portion 16B can have a diameter that gradually increases from a front end 30A to the back end 30B of the flotation component 12B. While the ends are respectively referred to as front and back for clarity, it is understood that the flotation component 12B can be secured to a swimmer such that either end faces forward or backward while the swimmer is swimming. For example, the narrower end can face forward and can provide a more comfortable transition between the user's legs. Alternatively, as illustrated in FIG. 3E, the wider back end 30B (first end) of the flotation component 12B can face forward and the narrower front end 30A (second end) of the flotation component 12B can face backward while the swimmer 2 is swimming, which creates a force that counteracts the rearward pressure of water flow as the swimmer 2 moves forward in the water. Regardless, in an embodiment, a minimum diameter of the narrowed waist portion 16B at the front end 30A is approximately 75% (e.g., in a range of 55% to 95%) of the minimum diameter of the narrowed waist portion 16B at the back end 30B. For example, the back end 30B can have a diameter of approximately 2 inches, while the front end 30A can have a diameter of approximately 1.5 inches. However, it is understood that any amount of tapering can be utilized. As illustrated, the tapering can be a constant tapering that extends along substantially all of the front to back width of the flotation component. However, it is understood that alternative embodiments can include a tapering that extends over only a portion and/or varies over the front to back width of the flotation component.

Similar to the pull buoy 10A, the pull buoy 10B is shown including a strap 14A that is configured and internally routed through the flotation component 12B in the same manner as the strap shown and described in conjunction with the pull buoy 10A. However, it is understood that there are various alternative configurations for configuring and/or routing a mechanism for securing a pull buoy described herein to a swimmer.

Figure 4A:
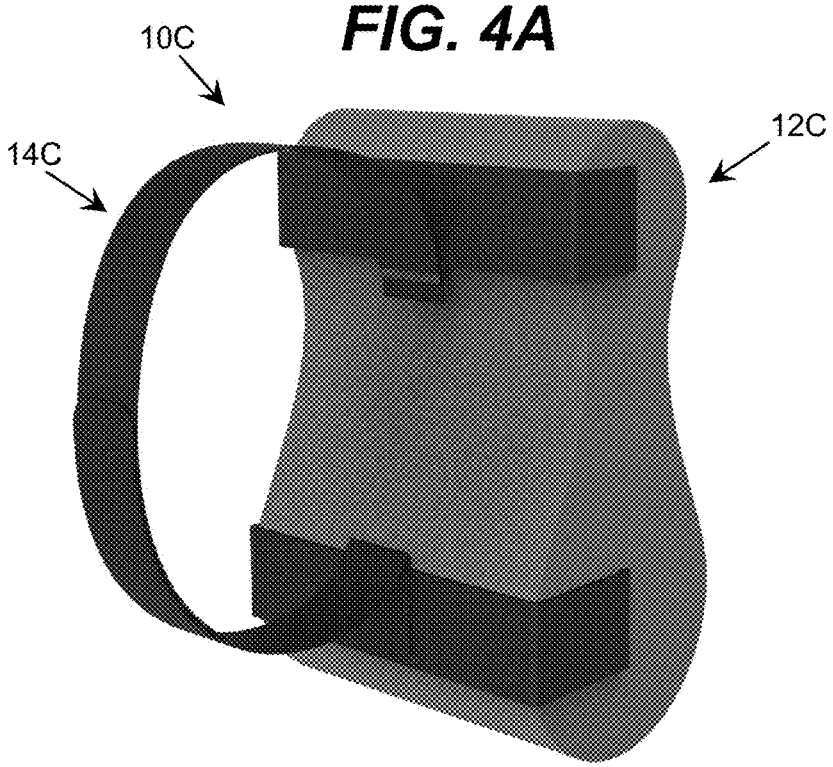
FIGS. 4A and 4B show an illustrative buoy and the corresponding parts according to an embodiment.
Figure 4B:
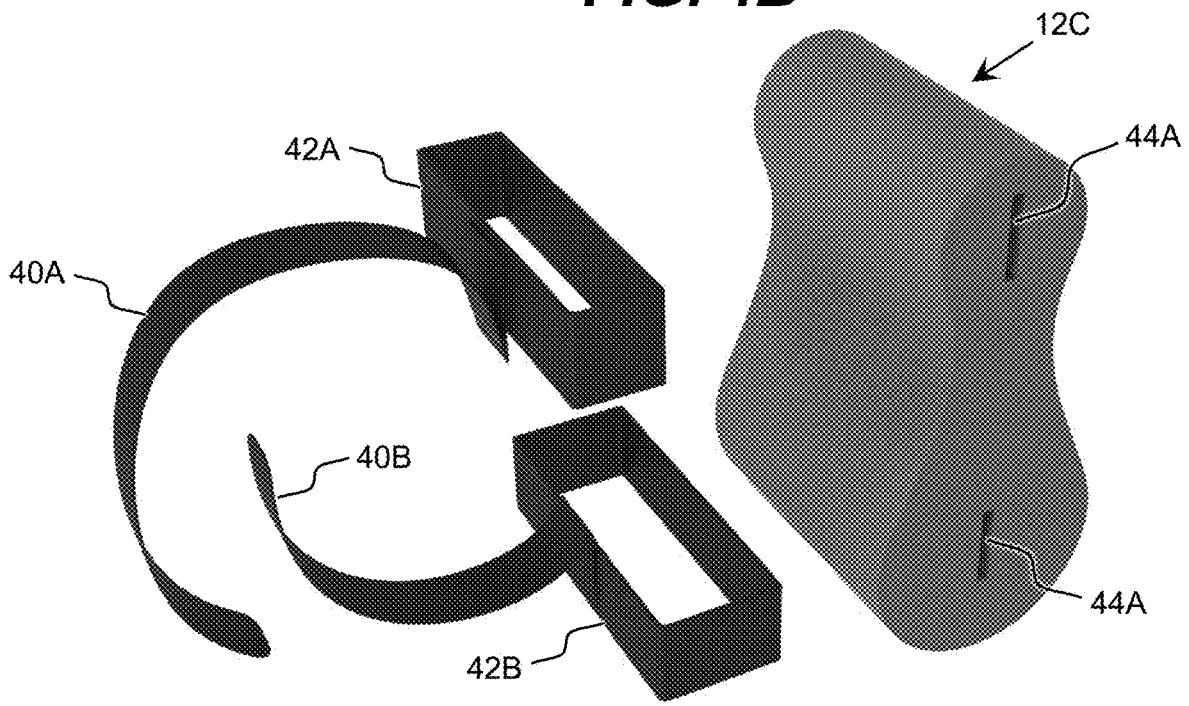

To this extent, FIGS. 4A and 4B show an illustrative pull buoy 10C and the corresponding parts according to an embodiment. In this case, the strap 14C comprises a top strap 40A and a bottom strap 40B, which are attached to top and bottom webbings 42A, 42B, respectively. The top and bottom webbings 42A, 42B can be fabricated from any suitable material, such as nylon, neoprene, plastic, and/or the like. Each strap 40A, 40B can be attached to the corresponding webbing 42A, 42B using any solution, e.g., stitching, adhesive, and/or the like. As illustrated, each webbing 42A, 42B can be attached to the flotation component 12C by being inserted into a corresponding top or bottom slot 44A, 44B. Each slot 44A, 44B can extend along the entire width of the flotation component 12C from the front to the back. Some or all of each webbing 42A, 42B can be fabricated from a material, such as plastic, having a stiffness that facilitates inserting and routing the webbing 42A, 42B through the slot 44A, 44B. Alternatively, each webbing 42A, 42B can be threaded through the corresponding slot 44A, 44B during a manufacturing process (e.g., prior to attaching two sides of the flotation component 12C together).

Figure 5A:
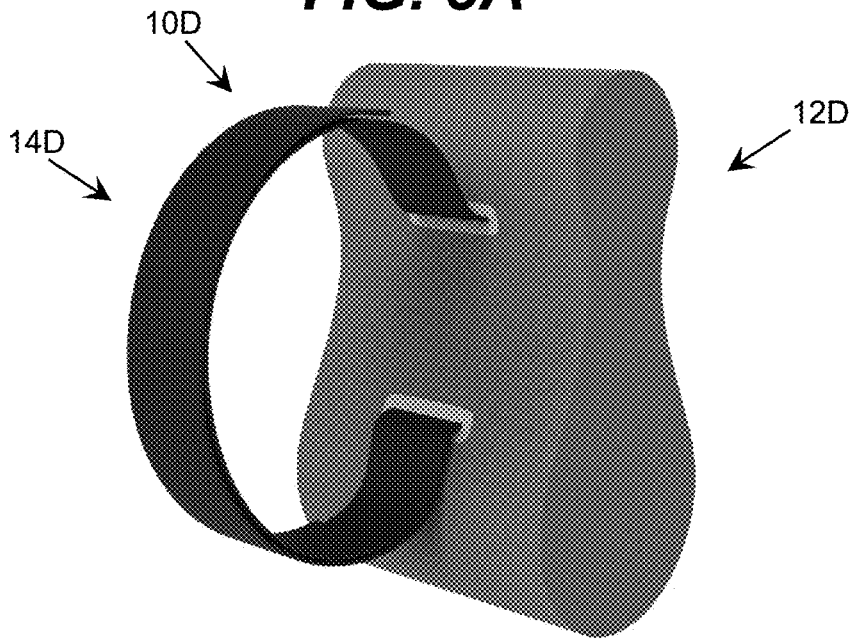
FIGS. 5A and 5B show an illustrative buoy and the corresponding parts according to another embodiment.
Figure 5B:
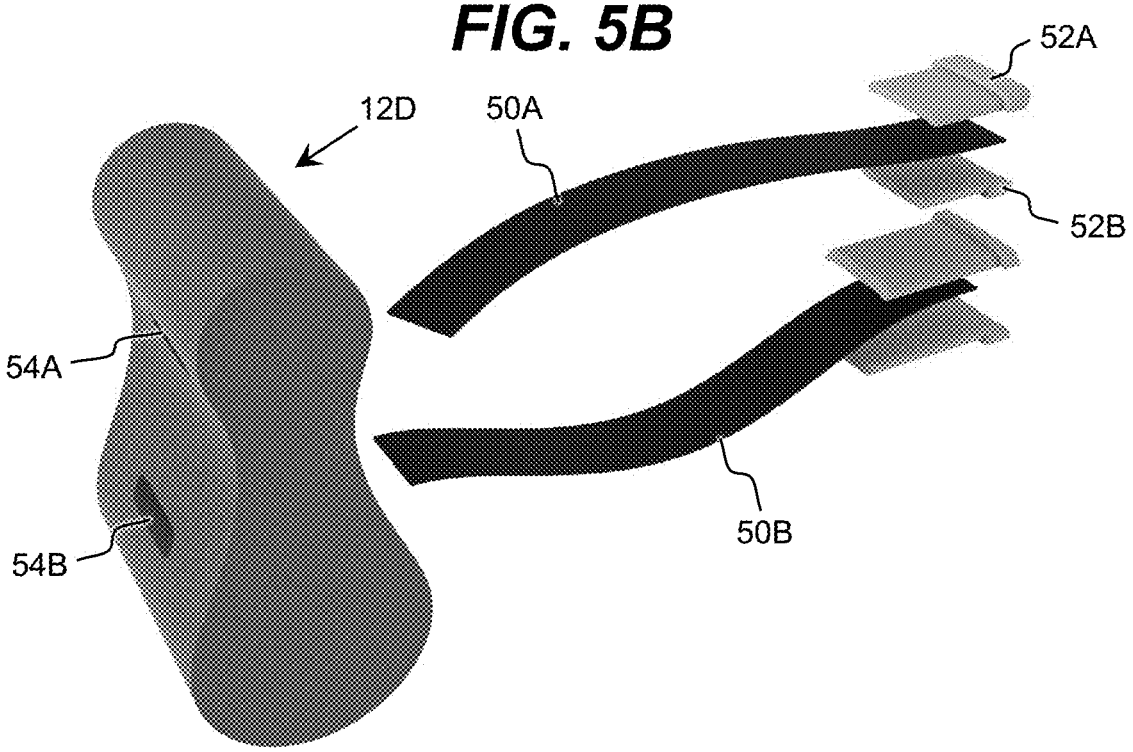

FIGS. 5A and 5B show an illustrative pull buoy 10D and the corresponding parts according to another embodiment. In this case, the strap 14D comprises a top strap 50A and a bottom strap 50B, each of has an end inserted into top and bottom slots 54A, 54B, respectively, and held in place by a pair of inserts 52A, 52B, respectively. In particular, the end of each strap 50A, 50B can be permanently affixed between the pair of inserts 52A, 52B using any solution, e.g., an adhesive, stitching, one or more penetrating mechanical fasteners (e.g., spikes), and/or the like. The inserts 52A, 52B can be sized to securely fit within the slots 52A, 52B. Additionally, the inserts 52A, 52B can be adhered to the slots 52A, 52B using any suitable adhesive.

Figure 6A:
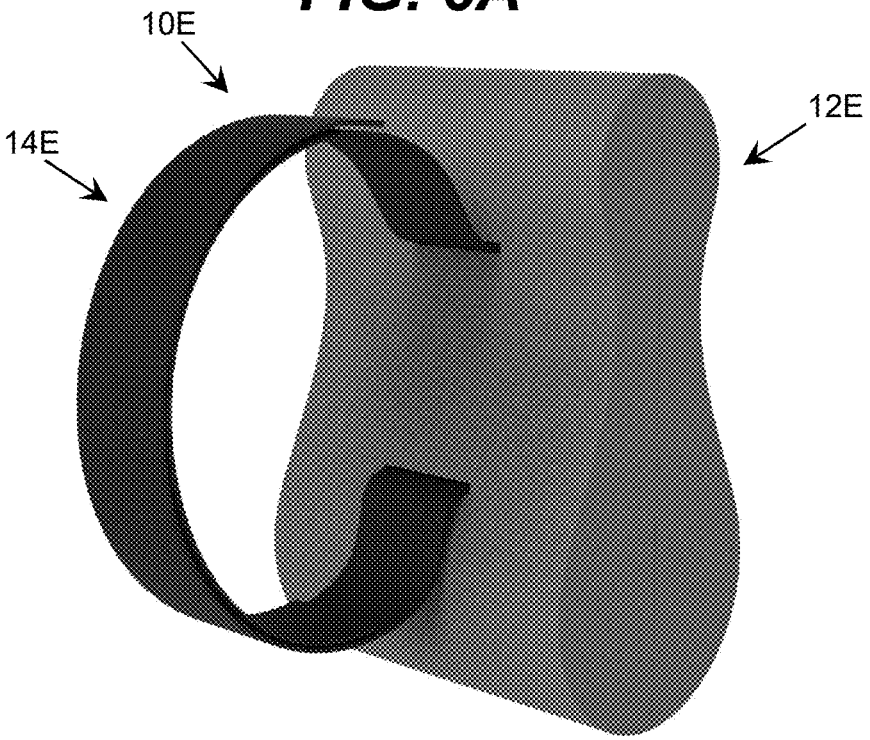
FIGS. 6A and 6B show an illustrative buoy and the corresponding parts according to still another embodiment.
Figure 6B:
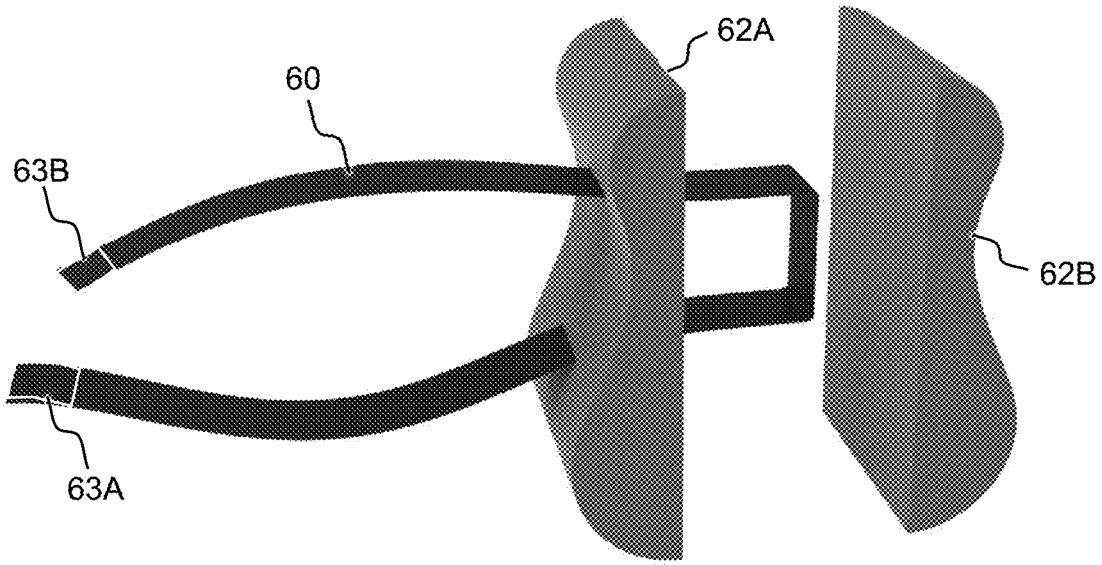

FIGS. 6A and 6B show an illustrative pull buoy 10E and the corresponding parts according to still another embodiment. In this case, the strap 14E is formed of a single strap 60, which is routed within the flotation component 12E. The flotation component 12E can be formed from two foam pieces 62A, 62B, which can be permanently affixed to one another using any solution, e.g., an adhesive, one or more penetrating mechanical fasteners (e.g., spikes), and/or the like, after the strap 60 is routed through the foam piece 62A including top and bottom slots.

Figure 7A:
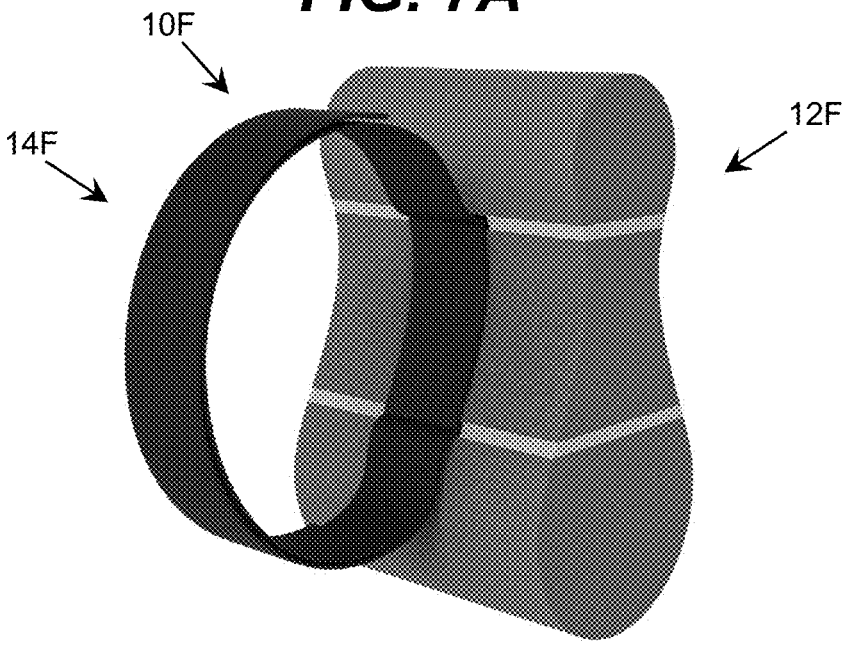
FIGS. 7A and 7B show an illustrative buoy and the corresponding parts according to yet another embodiment.
Figure 7B:
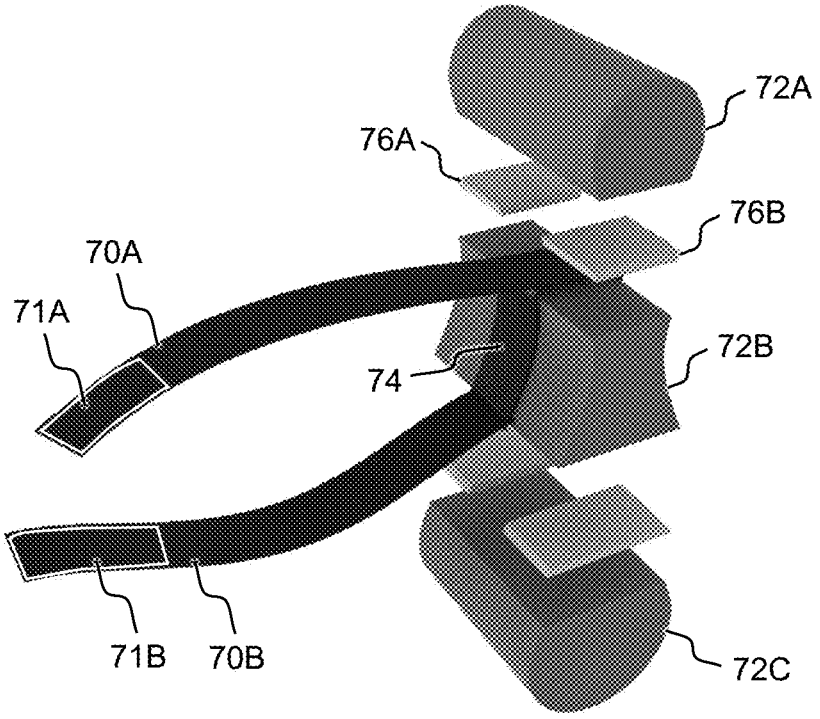

FIGS. 7A and 7B show an illustrative pull buoy 10F and the corresponding parts according to yet another embodiment. In this case, the flotation component 12E is formed from three foam pieces 72A-72C and two pairs of inserts 76A, 76B. Each pair of inserts 76A, 76B is sized to form a slot for securing a top and bottom strap 70A, 70B that form the strap 14F to the flotation component 12E. The inserts 76A, 76B can be fabricated from any suitable material, such as foam. Each strap 70A, 70B can be secured to a webbing 74, which is wrapped around the center foam piece 72B. The various parts can be permanently affixed using any combination of one or more of the suitable solutions described herein.

Figure 8:
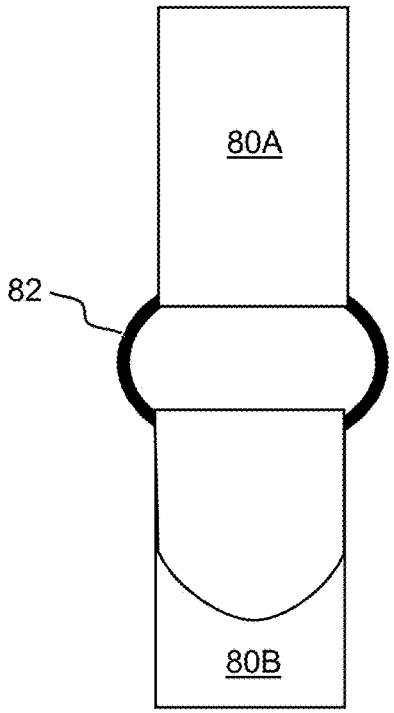
FIG. 8 shows an alternative solution for securing strap ends according to an embodiment.

In the various embodiments shown in FIGS. 1A-7B, the straps include ends that can be secured with hook and loop fasteners, with one strap end including a strip, such as mechanism 71A shown in FIG. 7B, including the hooks and the other strap end including a strip, such as mechanism 71B shown in FIG. 7B, including the loops. However, it is understood that this configuration is only illustrative of various possible configurations for securing the strap ends. For example, FIG. 8 shows an alternative solution for securing strap ends 80A, 80B according to an embodiment.

In this case, the strap end 80A includes a wraparound clasp 82 (e.g., a metal clasp), which allows the strap end 80B to be looped through and folded back to fasten onto itself. The strap end 80B can include any mechanism for securing different regions of the strap to each other. For example, the strap end 80B can include a hook strip and a loop strip which can be in alignment when the strap end 80B is folded over as illustrated. Regardless, it is understood that the corresponding strips can be sized to allow the strap ends to be secured to one another in various locations to accommodate a range of possible leg sizes. Furthermore, the area of contact for the loops and hooks can be selected to be sufficiently large to provide a secure connection during normal use of the pull buoy.

In each of the embodiments shown in FIGS. 4A-7B, the corresponding strap includes ends that are secured to the flotation component along a lateral side of the pull buoy at locations that are some distance from the top and bottom of the flotation component. As discussed herein, the locations can be at least approximately 20% from the respective top and bottom of the flotation component. Additionally, the locations can be between a vertical center of the buoy and a vertical location of the corresponding top or bottom lateral diameter. Regardless, the locations can be selected to accommodate a leg of a target size.

Figure 9:
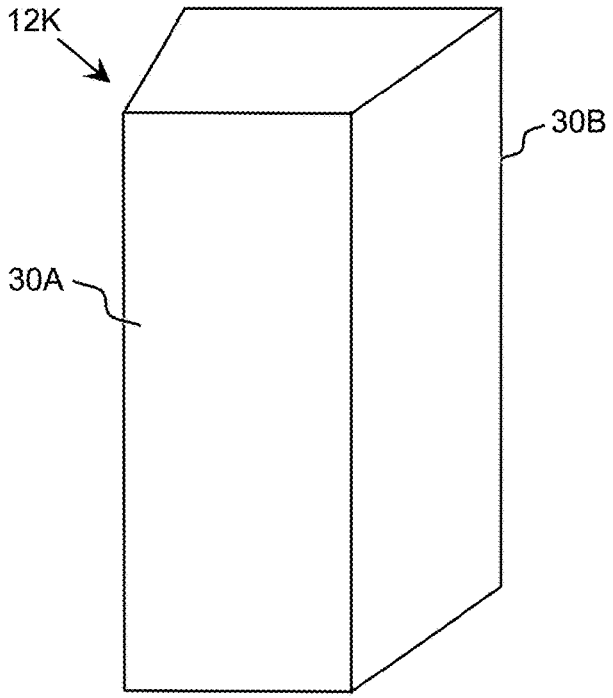
FIG. 9 shows an illustrative flotation component according to an embodiment.

In the various embodiments shown in FIGS. 1A-7B, the flotation components are shown as having a generally figure-eight frontal cross section, which is symmetrical about the top to bottom center axis that runs from the front to the back of the flotation component. However, it is understood that any of various alternative cross sectional shapes can be implemented in any of the embodiments described herein. For example, FIG. 9 shows an illustrative flotation component 12K according to an embodiment. In this case, the flotation component 12K does not include a narrowed region or rounded edges. Additionally, the flotation component 12K has a tapered diameter that decreases from a back side 30B of the flotation component to a front side 30A of the flotation component 12K. While the flotation component 12K is shown as having a constant height along both its lateral and front to back widths, it is understood that the flotation component 12K can have a height that varies along one or both of these dimensions.

Figure 10:
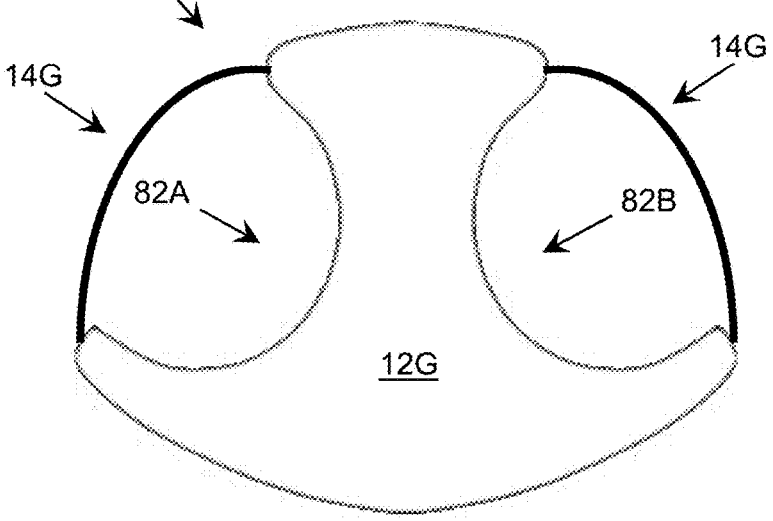
FIG. 10 shows a frontal cross section of an illustrative buoy according to an embodiment.

FIG. 10 shows a frontal cross section of an illustrative buoy 10G according to an embodiment. In this case, each lateral side 82A, 82B of the flotation component 12G includes additional material in the top and bottom regions to form a deeper narrowed waist portion. The sides 82A, 82B can be shaped and sized to securely fit about a corresponding part of a leg of a swimmer. In an embodiment, the larger bottom region can be placed on a side of the swimmer's legs that will be facing down while the swimmer is swimming. In this configuration, the bottom region can provide additional support for the swimmer's legs. Furthermore, the buoy 10G is shown including a pair of straps 14G. The straps 14G can be configured to secure the sides 82A, 82B to both legs of a swimmer. The straps 14G can be formed of any material described herein, and can be routed through an internal portion of the flotation component 12G using any solution described herein. In an embodiment, each strap 14G is formed of a material having an elasticity which creates tension between the swimmer's leg and the flotation component 12G. For example, the straps 14G could be exposed regions of one or two elastic straps that are internally routed in the flotation component 12G. While the buoy 10G is shown including two straps 14G, it is understood that the buoy 10G can be implemented with one strap.

Figure 11A:
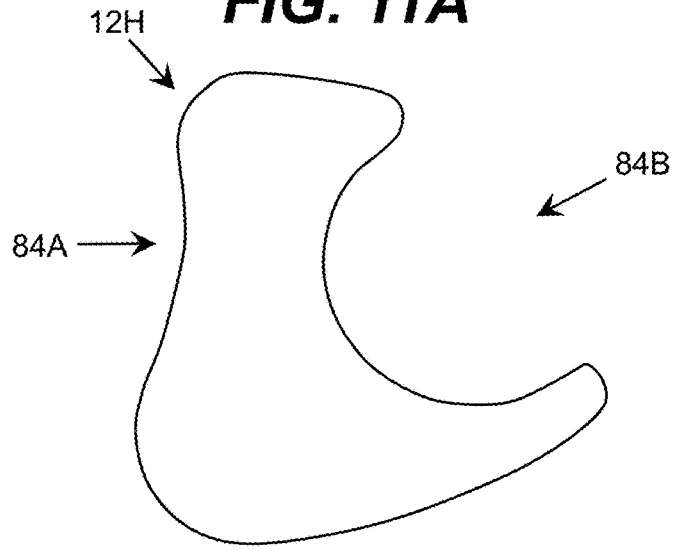
FIGS. 11A-11C show cross sections of illustrative flotation components according to embodiments.
Figure 11B:
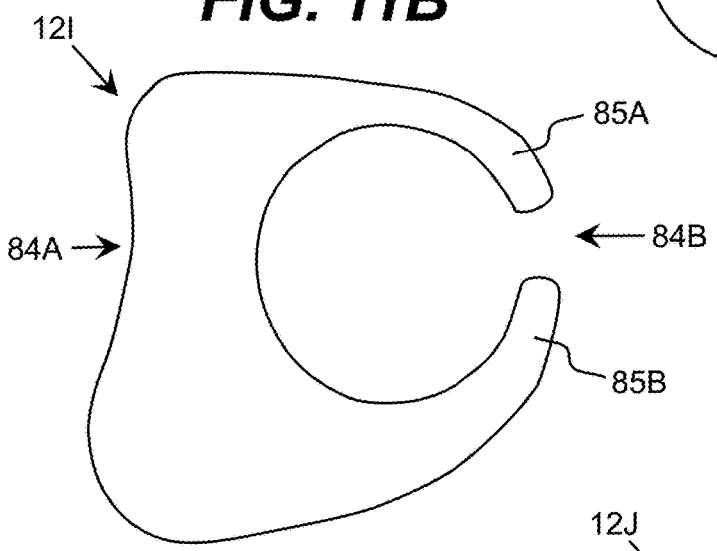
Figure 11C:
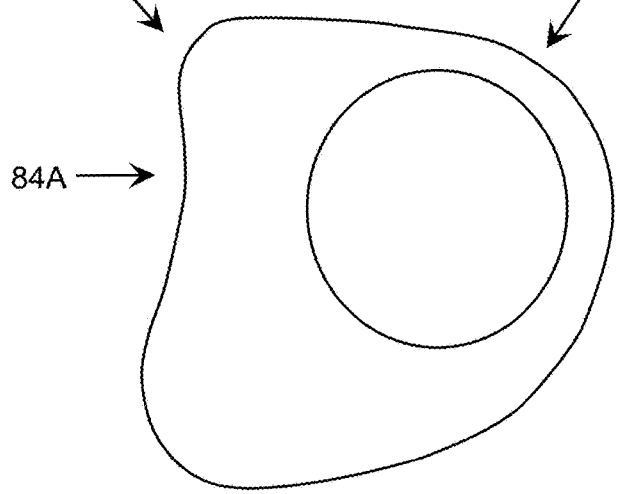

Additionally, embodiments of a flotation component described herein can have a shape that is non-symmetrical about the top to bottom center axis that runs from the front to the back of the flotation component. For example, FIGS. 11A-11C show cross sections of illustrative flotation components 12H-12J according to embodiments. In each case, the flotation component 12H-12J has a first side 84A having a relatively shallow narrowed waist portion, while the opposite side 84B includes additional material in the top and bottom regions to form a deeper narrowed waist portion and/or an opening into which the swimmer's leg can be inserted. The side 84B can be shaped and sized to securely fit about a corresponding part of a leg of a swimmer. In FIG. 11B, the extensions of material 85A, 85B in the top and bottom regions can form a significant portion of a hole (e.g., at least seventy-five percent), without connecting.

Any of the flotation components shown in FIGS. 9 and 11A-11C can be utilized to fabricate a pull buoy including a strap for securing a lateral side of the flotation component to a leg of a user as described herein. The strap can be located on either lateral side of the flotation components shown in FIGS. 9 and 11A-11B and on the first side 84A of the flotation component 12J shown in FIG. 11C. The strap can be secured to the flotation component using any of the solutions described herein.

For example, for the flotation component 12H shown in FIG. 11A, a strap can be located on the side 84A, but not on the side 84B. In this configuration, the extension of material on the side 84B allows the swimmer to easily place his/her leg in the flotation component 12H, e.g., after a turn. Additionally, the material on the side 84B can reduce upward rotational pressure around the strapped leg on the side 84A, which can be caused by the pressure of the water pushing up on the flotation component 12H. However, it is understood that such a strap location is only illustrative, and a pull buoy including the flotation component 12H can include a strap located on the side 84B, but not on the side 84A.

While most of the various pull buoys shown herein include only a single strap, it is understood that any of the pull buoys described herein can include multiple straps and/or a strap configured to secure both legs of the swimmer to both sides of the flotation component. For example, a pull buoy described herein can include a second strap located on the opposite lateral side of the flotation component. Both straps can be configured similarly or include different mechanisms for creating tension between the pull buoy and the leg of the swimmer. In an illustrative embodiment, a single strap can be routed through a flotation component to provide a snug fit on both legs of the swimmer. For example, the strap 14A shown in FIG. 1B can be routed and sized in a manner that allows a user to place one leg between the central portion 24C of the strap 14A and one side of the flotation component 12A and secure the other leg to the other side of the flotation component 12A by securing the ends 24A, 24B to one another. Additionally, a pull buoy can include multiple straps located on one lateral side of the flotation component, e.g., spaced from the front to back. In this case, each strap located on the same lateral side of the flotation component can be configured similarly or include different mechanisms for creating tension between the pull buoy and the leg of the swimmer.

In an embodiment, a strap described herein can be formed of a singular elastic material with no detachable ends (e.g., an elliptical strap). In this case, the strap can be formed of a material sized and having sufficient elasticity to allow the swimmer to insert his/her leg while still providing a snug, secure fit. Such a strap can be formed of a neoprene fabric, rubber, and/or the like. Additionally, the strap can include one or more features to increase an amount of friction against the swimmer's leg (e.g., flexible rubber beads or the like). In an embodiment, one or both lateral sides of the flotation component can include one or more features to increase an amount of friction against the swimmer's leg.

Alternatively, a pull buoy can be implemented without a strap, e.g., particularly when the flotation component includes lateral sides configured to create sufficient pressure to hold the flotation component in place while the user is swimming and making turns in a pool. For example, the flotation components shown in FIGS. 11B and 11C can be sized and can be formed from a material having adequate elasticity to allow the swimmer to insert his/her leg into the opening on the side 82B, but still have enough tension to fit securely around a swimmer's leg without the use of a strap.

It is understood that in any of the embodiments, the clasping options for the straps are illustrative only. A variety of foam combinations may be implemented for any of the embodiments. For example, a softer material may be incorporated in the area surrounding the leg to encourage a more snug fit. Finally, the strap itself may route internally or its ends may be mounted onto the surface of the flotation component using any solution.

The foregoing description of various aspects of the invention has been presented for purposes of illustration and description. The exact form of the buoy may vary. The description is not intended to be exhaustive or to limit the invention to the precise form disclosed, and obviously, many modifications and variations are possible. Such modifications and variations that may be apparent to an individual in the art are included within the scope of the invention as defined by the accompanying claims.

What is claimed is:

1. A buoy, comprising:

a flotation component configured for securing between legs of a swimmer, wherein the flotation component includes a first end facing and located closer to a torso of the swimmer than a second end located opposite the first end and facing feet of the swimmer, and lateral sides adjacent to the legs when the flotation component is secured between the legs of the swimmer, wherein the flotation component further includes:

a top portion having a first lateral diameter, wherein the top portion is located on one of: a front or back of the legs when the flotation component is secured between the legs of the swimmer;

a waist portion having a second lateral diameter smaller than the first lateral diameter, wherein the second lateral diameter gradually decreases along substantially all of the lateral sides of the waist portion from the first end of the flotation component to the second end of the flotation component; and a bottom portion having a third lateral diameter larger than the second lateral diameter, wherein the bottom portion is located on the other of: the front or back of the legs when the flotation component is secured between the legs of the swimmer.

2. The buoy of claim 1, further comprising at least one strap extending from a top location and a bottom location on a first lateral side of the flotation component, wherein the top location is located between a vertical center of the buoy and a vertical location of the first lateral diameter, and wherein the bottom location is located between the vertical center of the buoy and a vertical location of the third lateral diameter.

3. The buoy of claim 2, further comprising a hook and loop fastener located on at least one external end of the at least one strap.

4. The buoy of claim 2, further comprising a buckle located on each external end of the at least one strap.

5. The buoy of claim 2, wherein an elasticity of the at least one strap causes the at least one strap to secure one of the legs to the first lateral side of the flotation component.

6. The buoy of claim 2, wherein a second lateral side of the bottom portion of the flotation component includes an extension of material configured to support a leg of the swimmer.

7. The buoy of claim 2, wherein the top location and the bottom location correspond to openings in the flotation component, and wherein the at least one strap is internally routed within the flotation component.

8. The buoy of claim 7, wherein the at least one strap is routed through a pair of angled slots located within the flotation component.

9. The buoy of claim 2, further comprising a second strap extending from top and bottom locations on a second lateral side of the flotation component, wherein the second strap is configured to secure another of the legs to the second lateral side of the flotation component.

10. The buoy of claim 1, wherein at least one lateral side of the bottom portion of the flotation component includes an extension of material configured to support a leg of the swimmer.

11. A buoy, comprising:

a flotation component configured for securing between legs of a swimmer, wherein the flotation component includes a first end facing and located closer to a torso of the swimmer than a second end located opposite the first end and facing feet of the swimmer, and lateral sides adjacent to the legs when the flotation component is secured between the legs of the swimmer, wherein the flotation component further includes:

a top portion;

a waist portion having a lateral diameter that gradually decreases along substantially all of the lateral sides of the waist portion from the first end of the flotation component to the second end of the flotation component; and a bottom portion; and a strap including two ends extending from a top location and a bottom location on a first lateral side of the flotation component, wherein the top location is located between a vertical center of the buoy and a vertical midpoint of the top portion, and wherein the bottom location is located between the vertical center of the buoy and a vertical midpoint of the bottom portion; and at least one mechanism for securing the two ends of the strap around one of the legs.

12. The buoy of claim 11, wherein the at least one mechanism for securing includes a hook and loop fastener located on at least one external end of the at least one strap.

13. The buoy of claim 11, wherein the at least one mechanism for securing includes a buckle located on each external end of the at least one strap.

14. The buoy of claim 11, wherein a second lateral side of the bottom portion of the flotation component includes an extension of material configured to support a leg of the swimmer.

15. The buoy of claim 11, wherein a lateral diameter of the bottom portion is larger than a lateral diameter of the top portion.

16. A buoy, comprising:

a flotation component configured for securing between legs of a swimmer, wherein the flotation component includes a first end facing and located closer to a torso of the swimmer than a second end located opposite the first end and facing feet of the swimmer, and lateral sides adjacent to the legs when the flotation component is secured between the legs of the swimmer, wherein the flotation component further includes:

a top portion;

a waist portion having a lateral diameter that gradually decreases along substantially all of the lateral sides of the waist portion from the first end of the flotation component to the second end of the flotation component; and a bottom portion.

17. The buoy of claim 16, wherein both the top portion and the bottom portion have lateral diameters larger than the waist portion.

18. The buoy of claim 17, wherein the lateral diameters of the top portion and the bottom portion remain substantially uniform along substantially all of a distance between the first end of the flotation component to the second end of the flotation component.

19. The buoy of claim 16, wherein the lateral diameter of the waist portion at the second end is approximately 75% of the lateral diameter of the waist portion at the first end.

20. The buoy of claim 16, wherein at least one of the lateral sides of the flotation component is configured to securely fit about the leg of the swimmer.

* * * * *